US008413977B2

(12) United States Patent
Buerge

(10) Patent No.: US 8,413,977 B2
(45) Date of Patent: Apr. 9, 2013

(54) DEVICE AND METHOD FOR DELIVERING PRINTED PRODUCTS FROM A SADDLE-SHAPED SUPPORT

(75) Inventor: Marcel Buerge, Niedergoesgen (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 13/425,446

(22) Filed: Mar. 21, 2012

(65) Prior Publication Data

US 2012/0248676 A1 Oct. 4, 2012

(30) Foreign Application Priority Data

Mar. 30, 2011 (CH) ..... 0575/11

(51) Int. Cl.
*B65H 5/32* (2006.01)

(52) U.S. Cl.
USPC ..... 270/52.26; 270/52.29; 198/644

(58) Field of Classification Search ..... 270/52.26, 270/52.29, 52.18; 198/644
See application file for complete search history.

(56) References Cited

U.S. PATENT DOCUMENTS

| | | | | |
|---|---|---|---|---|
| 3,591,165 | A | 7/1971 | McCahon et al. | |
| 5,377,965 | A * | 1/1995 | Mandel et al. | 270/37 |
| 6,095,740 | A * | 8/2000 | Hollenstein et al. | 412/4 |
| 6,142,354 | A * | 11/2000 | Boss et al. | 227/100 |
| 6,540,066 | B1 * | 4/2003 | Von Aesch | 198/644 |
| 6,554,267 | B2 * | 4/2003 | Trovinger | 270/52.18 |
| 7,090,212 | B2 * | 8/2006 | Hediger | 270/52.26 |
| 7,628,389 | B2 * | 12/2009 | Steinert et al. | 270/52.26 |
| 7,628,390 | B2 * | 12/2009 | Stauber | 270/52.26 |
| 8,066,111 | B2 * | 11/2011 | Curley | 198/644 |
| 2005/0225023 | A1 * | 10/2005 | Schlough | 271/69 |

FOREIGN PATENT DOCUMENTS

| | | | |
|---|---|---|---|
| DE | 1198784 | B | 8/1965 |
| EP | 1072546 | A | 1/2001 |
| WO | WO 2008008301 | A2 | 1/2008 |

* cited by examiner

*Primary Examiner* — Patrick Mackey
(74) *Attorney, Agent, or Firm* — Leydig, Voit & Mayer, Ltd.

(57) ABSTRACT

A device for delivering a printed product from a saddle-shaped support includes at least two discs that are configured to pass through a gap that extends in a conveying direction and that is disposed, at least in a delivery region, between two support parts of the saddle-shaped support. The at least two discs are rotatable about respective fixed rotation axles that are mutually spaced from one another in the conveying direction. Each of the discs is configured to project intermittently, during the rotation about the respective fixed rotation axles, above a ridge line of the ridge in the delivery region of the saddle-shaped support so as to continuously lift the printed product from the saddle-shaped support in the delivery region.

17 Claims, 4 Drawing Sheets

DEVICE AND METHOD FOR DELIVERING PRINTED PRODUCTS FROM A SADDLE-SHAPED SUPPORT

CROSS-REFERENCE TO PRIOR APPLICATION

Priority is claimed to Swiss Patent Application No. CH 00575/11, filed on Mar. 30, 2011, the entire disclosure of which is hereby incorporated by reference herein.

FIELD

The invention relates to a device and a method for delivering printed products from a saddle-shaped support.

BACKGROUND

Devices and methods of this type are known and are generally implemented in saddle stitchers. These are machines in which folded signatures are deposited on a saddle-shaped support in succession by a plurality of feeders, collated to form printed products, and bound. The printed products are subsequently passed to a means for further processing, for example a cutting device. In the saddle stitcher, at least in the region of the stitching means thereof, the signatures are often transported using what is known as a double collation chain, consisting of two individual collation chains arranged mutually parallel with spacing. In saddle stitchers equipped with a double collation chain of this type, the printed product is bound in the region of a free space between the two chains. Conveyor members in the form of dogs are arranged on the double collation chain and transport the signatures or printed products, straddling the saddle-shaped support, through the binder.

Solutions are further known in which merely a single collation chain, carrying the conveyor members, is used instead of a double collation chain, and along with a support part arranged substantially parallel thereto forms the saddle-shaped support. Finally, solutions are also known in which the saddle-shaped support is formed by two support parts arranged mutually parallel, whilst the printed products are transported on the saddle-shaped support by conveyor members arranged outside the saddle-shaped support. Irrespective of the construction of the saddle-shaped support, the signatures or printed products should be transported and delivered to the respective means for further processing as gently as possible, and a range of devices and methods have previously been developed for this purpose.

EP 1072546 A1 describes a device in which a saddle-shaped support having a ridge is depressed in the delivery region thereof. The printed products are slid onto a fixed blade, which is arranged in this region in a gap between the support parts of the saddle-shaped support and substantially flush with a ridge line extended into the delivery region, and from which said printed products are delivered by gripper members to a means for further processing.

US 2005/0225023 A1 relates to a device for transporting bound printed products consisting of signatures. The device comprises a saddle-shaped support, which is provided with a ridge and on which the printed products are transported by dogs, and a chain, which is provided with active members in the form of blades and introduces them, passing through upwards from below, into a gap in the saddle-shaped support in a delivery region. In this case, the printed products are lifted over a ridge line extended into the delivery region, and thus lifted from the saddle-shaped support and positioned for passing on to a rotating arm. The printed products are lifted to make them easier to grip. This leads to the problem that the gripper members have to receive the printed products precisely in the gap between two blades, in such a way that no undesirable marks are left on the printed products. The device is therefore complex to control, since for this purpose the conveyor members transporting the printed products on the saddle-shaped support, the chain carrying the blades, and the gripper members have to be very precisely synchronised.

WO 2008/008301 A2 describes an adjustable gripper arrangement

SUMMARY

In an embodiment, the present invention provides a device for delivering a printed product from a saddle-shaped support. The saddle-shaped support includes a ridge and conveying members and is configured to introduce the printed product, by the conveying members, in a conveying direction to a delivery region of the saddle-shaped support with the printed product straddling the ridge. At least one gripper member is configured to remove the printed product from the saddle-shaped support in the delivery region. The device includes at least two discs that are configured to pass through a gap that extends in the conveying direction and that is disposed, at least in the delivery region, between two support parts of the saddle-shaped support. The at least two discs are rotatable about respective fixed rotation axles that are mutually spaced from one another in the conveying direction. Each of the discs is configured to project intermittently, during the rotation about the respective fixed rotation axles, above a ridge line of the ridge in the delivery region of the saddle-shaped support so as to continuously lift the printed product from the saddle-shaped support in the delivery region.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

In the figures, like reference numerals denote structurally or functionally equivalent components.

DETAILED DESCRIPTION

An aspect of the invention is to provide a cost-effective device and a corresponding method for delivering printed products gently from a saddle-shaped support.

In an embodiment, the present invention provides a device and a method for delivering printed products from a saddle-shaped support, which comprises a ridge and on which the printed products are initially introduced, straddling the saddle, to a delivery region of the saddle-shaped support in a conveying direction by conveyor members, and finally removed from the delivery region by at least one gripper member, two support parts of the saddle-shaped support being arranged with mutual spacing so as to form between them a gap extending in the conveying direction, at least in the delivery region.

The device according to an embodiment of the invention comprises at least two discs, which are formed so as to be able to pass through the gap in the delivery region, are rotatable about respective fixed rotation axles mutually spaced in the conveying direction, and are formed so as to be able to project intermittently above a ridge line, extended into the delivery region, of the saddle-shaped support, so as to continuously lift the printed products from the delivery region of the saddle-shaped support while rotating about the rotation axles.

In a first embodiment of the device, the discs are formed substantially the same size, and configured in such a way that an uppermost circumferential point of each disc can project the same distance above the ridge line, extended into the delivery region, of the saddle-shaped support.

In a further embodiment of the device, the distance between the rotation axles and a respective uppermost circumferential point of the discs is angle-dependent, the discs each being formed substantially spiral-shaped at least in a circumferential region.

The device according to an embodiment of the invention is used in particular in a saddle stitcher.

In the method according to an embodiment of the invention, the printed products in the delivery region are each continuously lifted from the saddle-shaped support towards the at least one gripper member by at least two rotating discs, which pass through the gap and have respective fixed rotation axles mutually spaced in the conveying direction.

The device and the method make it possible to lift the printed products gently from the saddle-shaped support and thus to prepare them for corresponding removal.

Moreover, with the device according to an embodiment of the invention some parts can be omitted. Referring to US 2005/0225023 A1, the second chain and the associated members such as the blades are no longer necessary, for example. This reduces the manufacturing and maintenance costs of the device and in particular of the saddle stitcher as a whole.

Figure 1:
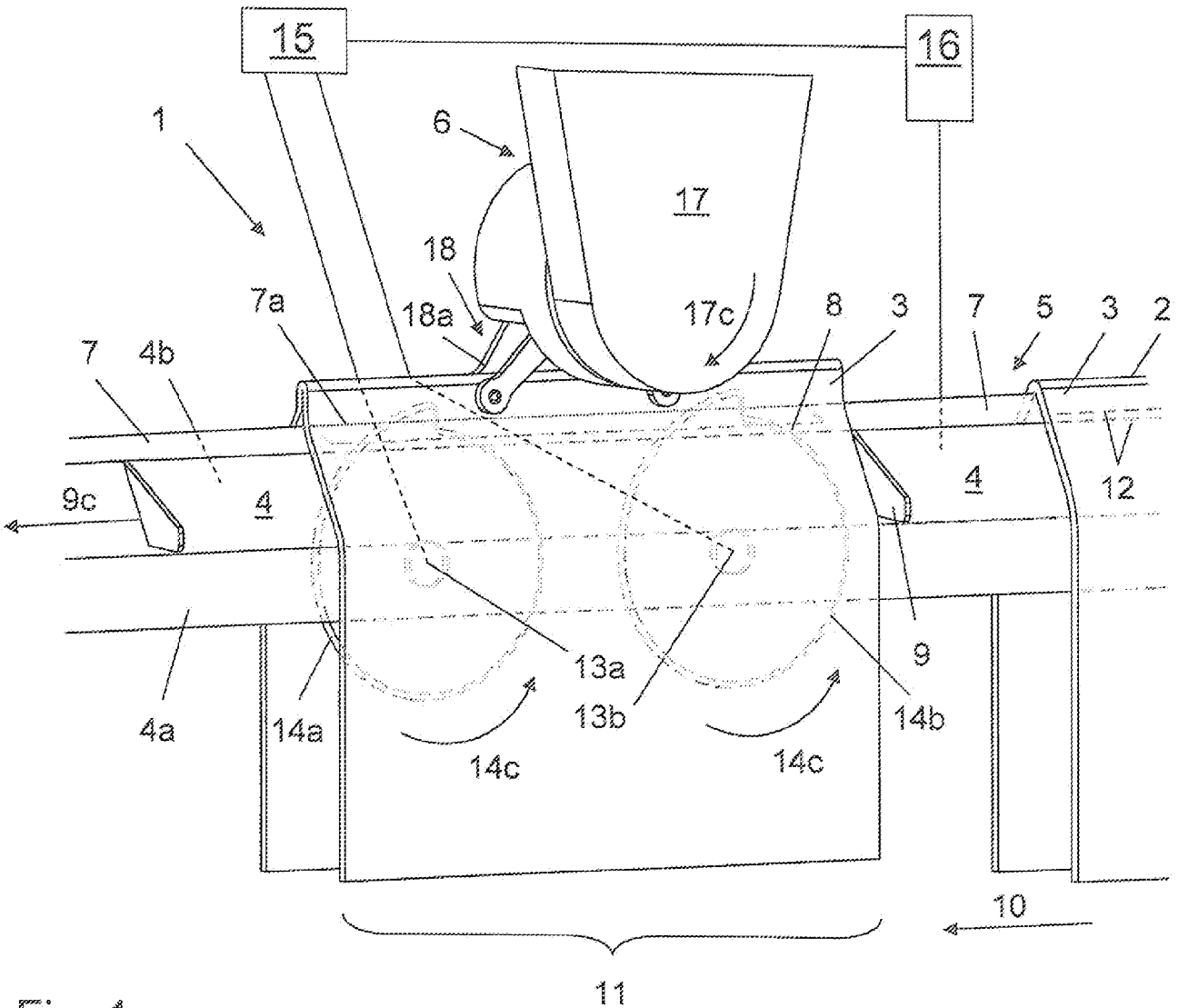
FIG. 1 is a perspective view of a device according to an embodiment of the invention.

FIG. 1 is a perspective view of a device 1 for delivering printed products 3, provided with a fold 2, from a saddle-shaped support 4 of a saddle stitcher 5 to a means 6 for further processing. The saddle-shaped support 4 comprises two support parts 4, 4*b*, arranged mutually parallel with spacing and formed as a collation chain, and a stationary ridge 7, which is arranged centrally between the support parts 4*a*, 4*b* and projecting past them and guides the printed products 3 in the region of the fold 2 thereof. A gap 8 in which the ridge 7 is arranged extends between the collation chains. A plurality of conveyor members 9 in the form of dogs are arranged on each collation chain and transport the printed products 3, straddling the ridge 7 and the saddle-shaped support 4, to a delivery region 11 in a conveying direction 10.

As an alternative to a double collation chain of this type, merely a single collation chain accommodating the conveyor members 9 may be used, and together with a support part arranged substantially parallel thereto forms the saddle-shaped support 4 and the gap 8. The saddle-shaped support 4 may also be formed by two support parts arranged mutually parallel, whilst the printed products are transported on the saddle-shaped support 4 by conveyor members 9 arranged outside the saddle-shaped support 4. In this case the gap 8 is formed between the support parts.

In FIG. 1, the front support part 4*a* is visible whilst the rear support part 4*b* is concealed by the ridge 7 and by a printed product 3, consisting of at least one signature and positioned on the saddle-shaped support 4 in the delivery region 11. Upper edges 12 of the saddle-shaped support 4 are also concealed, and are indicated by dashed lines in the delivery region 11. With the device 1, bound printed products 3 are generally lifted from the saddle-shaped support and thus prepared for passing on to the means 6 for further processing. Unbound printed products may also be used.

The printed products 3 are transported on the saddle-shaped support 4 by the conveyor members 9 fixed to the collation chains in the conveying direction 10, at a speed corresponding to the speed 9*c* of the conveyor members 9 or of the collation chains. In FIG. 1, a rear side of a printed product 3 is concealed in part by the front side thereof and by the support parts 4*a*, 4*b*.

The ridge 7 which guides the printed products 3 ends directly upstream from the delivery region 11, a ridge line 7*a* which extends at the height of the ridge 7 being extensible into the delivery region 11. The device 1 located in the delivery region 11 comprises two discs 14*a*, 14*b*, arranged in and passing through the gap 8 between the support parts 4*a* and 4*b* and rotating about respective fixed rotation axles 13*a*, 13*b* arranged mutually spaced in the conveying direction 10. The discs 14*a*, 14*b* are formed so as to be able to project intermittently above the ridge line 7*a*, extended into the delivery region 11, of the saddle-shaped support 4, so as to continuously lift the printed products 3 from the saddle-shaped support 4 while rotating about the rotation axles 13*a*, 13*b*. In addition, the discs 14*a*, 14*b* are arranged in succession in the conveying direction 10, in such a way that a first disc 14*a* arranged downstream is followed by a second disc 14*b* arranged upstream, said discs being located in a region of the gap 8 of the saddle-shaped support 4 which is concealed by the printed product 3 in the drawing of FIG. 1. The discs 14*a*, 14*b* can also be arranged mutually overlapping in part in the gap 8, in that the rotation axles 13*a*, 13*b* thereof are mutually offset in the conveying direction 10 from the position shown in FIG. 1, and the discs 14*a*, 14*b* are thus arranged mutually laterally offset. Alternatively, one of the discs 14*a*, 14*b* may be formed with a slot and the other disc 14*b*, 14*a* may be arranged so as to engage in the slot. It is preferred to use two discs 14*a*, 14*b*, but more than two discs may also be used.

An actuator 15 is provided for driving the discs 14*a*, 14*b* in rotation about the rotation axles 13*a*, 13*b* thereof. Drive trains or shaft trains of the discs 14*a*, 14*b* are indicated by connecting lines between the respective rotation axles 13*a*, 13*b* and the actuator 15. Embodiments of drives of this type are known and are not explained in greater detail herein. The actuator 15 preferably drives the discs 14*a*, 14*b* at the same constant angular velocity 14*c*. In another embodiment, of the device 1, each disc 14*a*, 14*b* is connected to a separate actuator, the discs 14*a*, 14*b* preferably being driven at a substantially equal constant angular velocity 14*c*. "Constant angular velocity" is taken herein to mean an angular velocity 14*c* which is constant over time when the device 1 is operating as intended. Alternatively, the discs 14*a*, 14*b* may also be driven by a drive of a stitching machine of the saddle stitcher.

Figure 3:
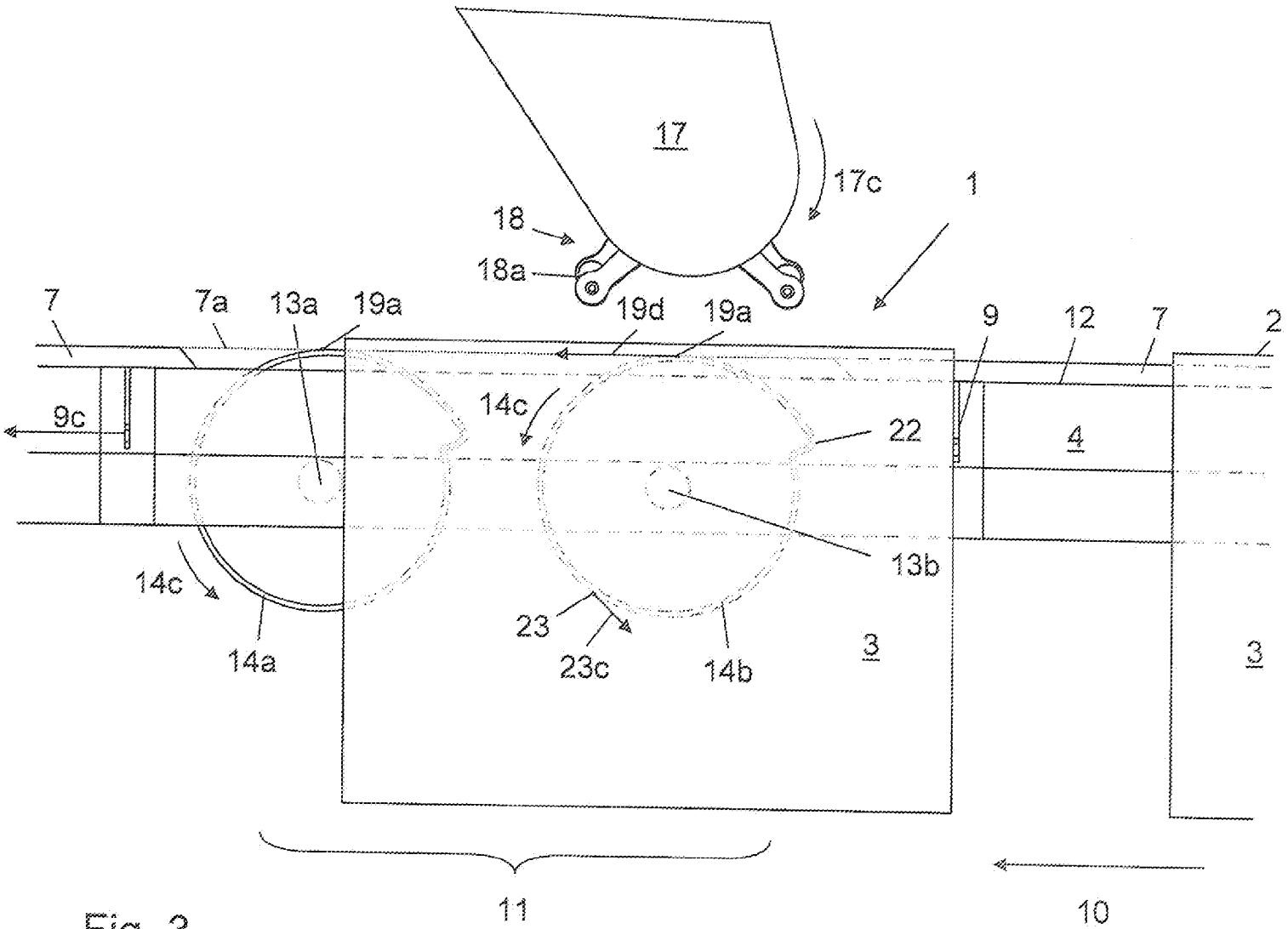
FIG. 3 is a side view of a device according to an embodiment of the invention in a second snapshot, at the moment when the discs first contact the printed product.

In addition, a control system 16 is provided for adjusting the angular velocity 14*c* of the discs 14*a*, 14*b*, and the operation thereof is explained in greater detail in relation to FIG. 3.

FIG. 1 also shows part of the means 6 for further processing, comprising an arm 17 which rotates at an angular velocity 17*c* and on which a gripper member 18 having two gripper fingers 18*a* is arranged for delivering the printed products 3 from the saddle-shaped support 4. The means 6 for further processing and/or the arm 17 and/or the gripper member 18 may also be configured differently. Embodiments thereof known to the person skilled in the art can be used as well.

Figure 2:
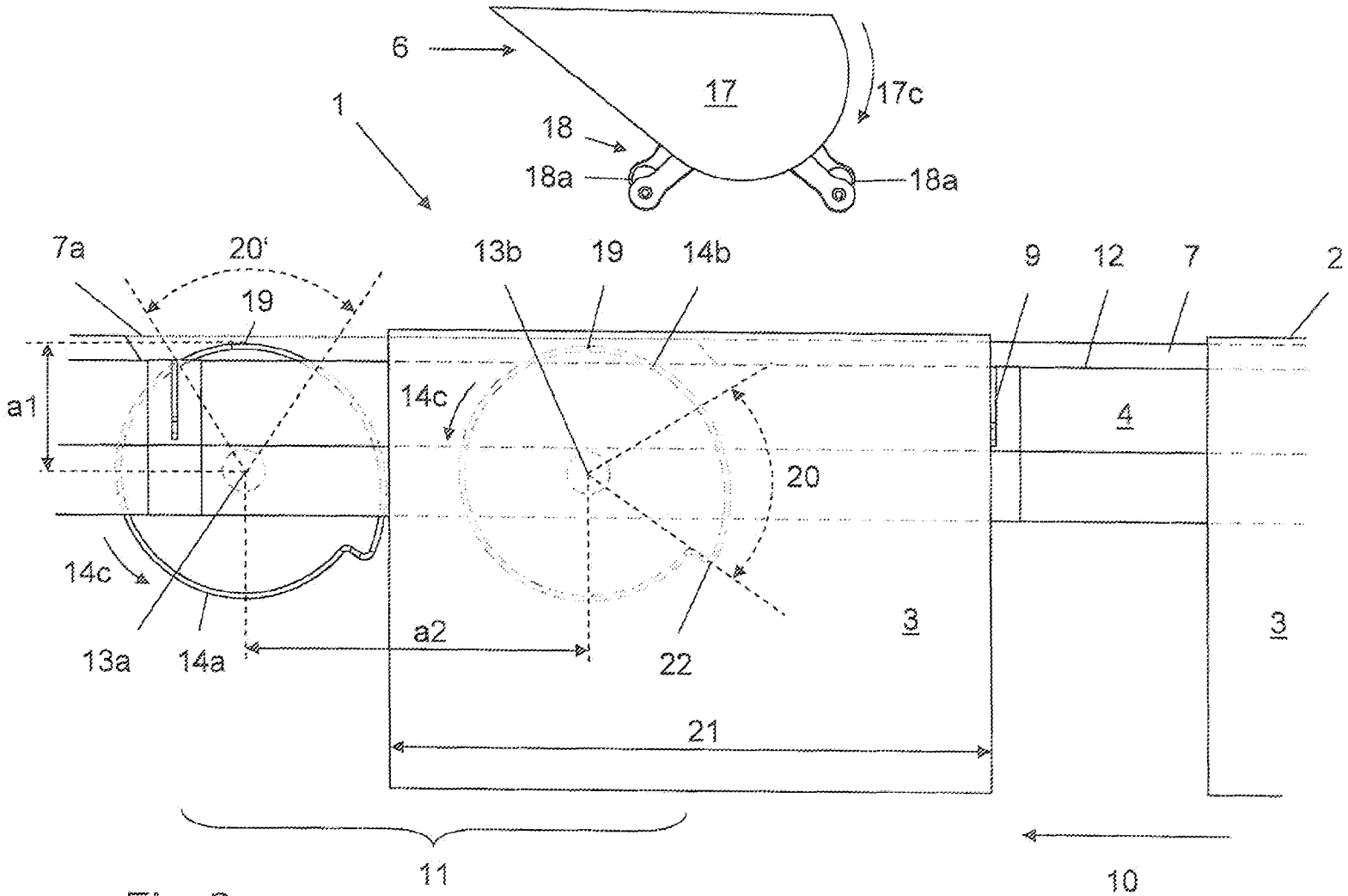
FIG. 2 is a side view of a device according to an embodiment of the invention in a first snapshot, with a printed product arriving in the delivery region.
Figure 4:
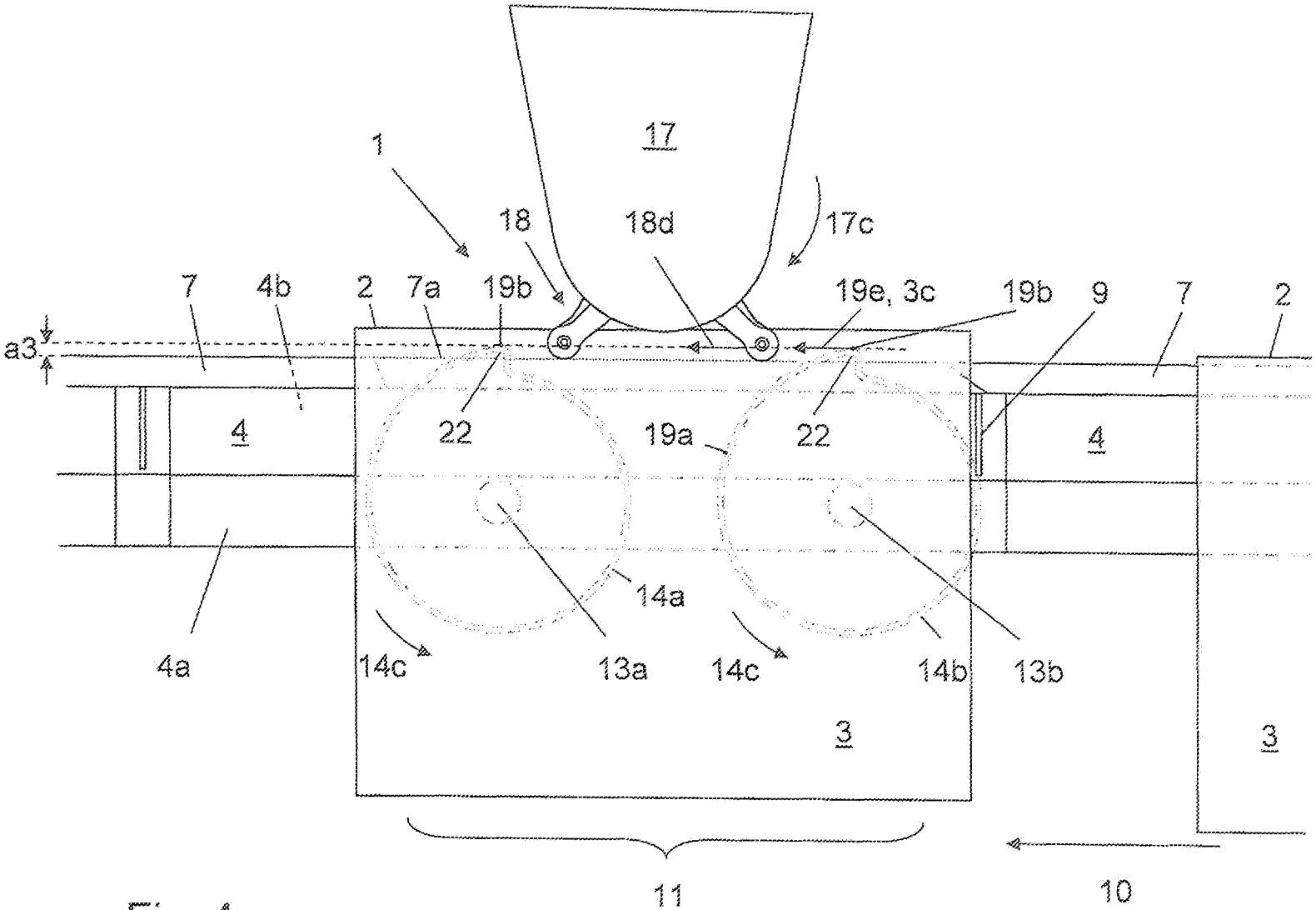
FIG. 4 is a side view of a device according to an embodiment of the invention in a third snapshot, with a printed product lifted by the discs, at the moment when it is removed from the delivery region.

FIGS. 2 to 4 are side views of the device 1 in three different snapshots. These snapshots show the delivery region 11 of the saddle-shaped support 4. In principle, throughout the application text, "delivery region" or "delivery" refers to the printed products 3 being lifted from the saddle-shaped support 4 by the device 1 and to the printed products 3 being released to the means 6 for further processing.

In the following, FIGS. 2 to 4 and the snapshots shown therein will be explained in greater detail, dashed lines again indicating that the respective component is concealed in the relevant region.

In particular in FIGS. 2 and 3, the orientation of the discs 14*a*, 14*b* may vary slightly from the actual orientation in a saddle-shaped support 4, in which a particular speed 9*c* of the conveyor members 9 or of the collation chains and a particular angular velocity 14*c* of the discs 14*a*, 14*b* prevail. The orientation shown of the discs 14*a*, 14*b* is therefore selected approximately and for illustrative purposes.

FIG. 2 is a snapshot of the device 1 with a printed product 3 arriving in the delivery region 11. In this case, the discs 14*a*, 14*b* are substantially the same size and are configured in such a way that the distance a1 between the rotation axles 13*a*, 13*b* thereof and a respective uppermost circumferential point 19 of the respective disc 14*a*, 14*b* is angle-dependent. In a preferred embodiment, the discs 14*a*, 14*b* are formed substantially spiral-shaped. Herein, the term "spiral-shaped" should be understood to the effect that the discs 14*a*, 14*b*, at least in a circumferential region 20, are substantially in the form of a root spiral or Archimedean spiral, in each case having a substantially round circumference. The spiral radius may also be based on a different growth function and increase from a minimum to a maximum spiral radius. As is shown in FIGS. 1 to 4, the spiral of the discs 14*a*, 14*b* is not formed over 360°, i.e. it initially has a constant radius, which for example increases in a spiral shape from an angle of approximately 120°. Differing configurations of the spiral are also possible. Finally, instead of spiral-shaped discs 14*a*, 14*b*, other, for example elliptical discs may be used.

The discs 14*a*, 14*b* are arranged with a fixed distance a2 between the rotation axles 13*a* and 13*b* thereof. Large-format printed products are thus transported far enough on the saddle-shaped support 4 that the discs 14*a*, 14*b* engage approximately centrally in order to lift them. If a printed product 3 having a fold 2 deviating from a parallel to the ridge line 7*a* of the saddle-shaped support 4 is to be passed on to the means 6 for further processing, this is carried out by an adjustment, by the control system 16, of the relative angular position of the discs 14*a*, 14*b*.

The discs 14*a*, 14*b* may also be driven in such a way that the angular position thereof can be adjusted relative to the conveyor members 9. In this way, with the discs 14*a*, 14*b*, printed products of different thickness and printed products of variable format can be lifted by the saddle-shaped support 4 in immediate succession, and thus provided to be taken up by the gripper fingers 18*a* of the gripper member 18. The device 1 is therefore also adapted for further processing of printed products 3 which are produced by digital printing machines and which may have thicknesses and/or formats which differ from printed product to printed product.

As an alternative to arranging the discs 14*a*, 14*b* at a fixed distance a2, this distance may also be formed so as to be adjustable. In this case, the minimum distance a2 should be selected in such a way that the discs 14*a*, 14*b* do not impede one another in rotation. The ability to adjust the distance a2 between the rotation axles 13*a*, 13*b* of the discs 14*a*, 14*b* has the advantage of providing increased flexibility as regards the maximum supported format of the printed products 3, specifically a height 21 of the printed products 3. The minimum height 21 is thus predetermined in a fixed manner by the minimum distance a2 between the rotation axles 13*a*, 13*b*. By contrast, the maximum height 21 of the printed products 3 can be varied by displacing the rotation axles 13*a*, 13*b* in opposite directions, i.e. by displacing the first rotation axle 13*a* in the conveying direction 10 and the second rotation axle 13*b* counter to the conveying direction 10.

Further, the discs 14*a*, 14*b* are preferably arranged so as to be exchangeable. In particular, they can be exchanged for discs of a different size and shape.

In an initial position, the discs 14*a*, 14*b* are orientated, i.e. calibrated, in such a way that after a printed product 3 is introduced into the delivery region 11, respective uppermost circumferential points 19*b* of the discs 14*a*, 14*b*, located on the largest radius of the discs 14*a*, 14*b*, project past the extended ridge line 7*a* of the saddle-shaped support 4 at least intermittently by the same distance a3 at the same moment, in such a way that the printed product is lifted from the support parts 4*a*, 4*b* (FIG. 4). Based on the size and shape thereof, the discs 14*a*, 14*b* are positioned in such a way as to run synchronously. Whether the respective uppermost circumferential points 19 thereof project past the extended ridge line 7*a* of the saddle-shaped support 4 intermittently or permanently after a printed product 3 is introduced into the delivery region 11 depends primarily on the distance of the fold 2 of the printed product 3 from the ridge 7 and thus on the respective formation of the printed product 3.

The discs 14*a*, 14*b* can for example be aligned relative to one another by hand. In particular, if an individual actuator 15 is used for each disc 14*a*, 14*b*, they can also be aligned automatically, in that the angular velocity 14*c* of each disc 14*a*, 14*b* is varied until a tab 22 of each disc 14*a*, 14*b*, formed by the transition from the largest to the smallest radius of the disc 14*a*, 14*b*, has passed through a corresponding control point at the same moment. The control points may for example be established using laser beams, which are interrupted simultaneously and for the same duration, by the tabs 22 of the respective discs 14*a*, 14*b* entering the laser beam, if the discs 14*a*, 14*b* are running synchronously. The angular velocities 14*c* of the discs 14*a*, 14*b* may change in such a way that the control system 16 actuates the respective actuator 15, to correct the angular speed 14*c* of the associated disc 14*a*, 14*b*, based on an evaluation of the data received by way of the interruption of the laser beams. This calibration method may also be used for intermediate calibration when the conveyor members 9 or the collation chains are running empty. Other known calibration methods may also be used.

During the transition from the situation shown in FIG. 2 to that shown in FIG. 3, the printed product 3 moves onwards in the conveying direction 10 while the discs 14*a*, 14*b* rotate at the angular velocity 14*c*. Because of the spiral-shaped formation thereof, the discs 14*a*, 14*b* do not project past the ridge line 7*a*, extended into the delivery region 11, of the saddle-shaped support 4 during this transport of the printed products 3 in the conveying direction 10, since there is a circumferential region 20', having "small" spiral radii, of the discs 14*a*, 14*b* in the region of the upper edges 12 of the saddle-shaped support 4. As a result, the printed product 3 is transported onwards unimpeded, over the disc 14*b* arranged upstream, by the conveyor members 9 of the collation chains, and thus reaches the disc 14*a* arranged downstream. Because of the further rotation thereof, the radius of the discs 14*a*, 14*b* has in the meantime increased, preferably continuously increased, at the currently uppermost circumferential point 19. When the printed product 3 extends over the two discs 14*a*, 14*b*, the radius of the discs 14*a*, 14*b* at a first, currently uppermost circumferential point 19*a* has reached a value such that the discs 14*a*, 14*b* initially contact the printed product 3 via the first circumferential point 19*a*, as is shown in FIG. 3 for the first circumferential point 19*a* of the second disc 14*b*, and subsequently lift said printed product continuously from the delivery region 11 of the saddle-shaped support 4. Depending on the configuration of the discs 14*a*, 14*b*, they may also be in contact with the printed product 3 even before the lifting.

To prevent damage to the printed product 3 or undesirable marks on the printed product 3 during lifting, a path velocity of the first uppermost circumferential point 19*a*, defined by the first contact of at least one of the discs 14*a*, 14*b* with the printed product 3 arriving in the delivery region 11, is selected in such a way that the size of a first path velocity component 19*d*, parallel to the conveying direction 10 of the conveyor members 9 and of the printed products 3 transported thereby, is substantially equal to the speed 9*c* of the conveyor members 9 of the collation chains. However, depending on the specific operating conditions, the speed 9*c* of the conveyor members 9 may also differ considerably from the path velocity component 19*d*.

The first, uppermost circumferential point 19*a* is shown in FIG. 3 as a black dot, and the path velocity component 19*d* thereof is shown by a horizontal arrow. Setting the first path velocity component 19*d* equal to the speed 9*c* of the conveyor members 9 means that the printed product 3 is not subjected to braking or acceleration, which could for example lead to abrasion of the fold 2 on the discs 14*a*, 14*b* or of the printed product 3 on the conveyor members 9 of the collation chains. In FIG. 3, the path velocity 23*c* of an arbitrary circumferential point 23 is shown by an arrow so as to clarify the difference from the angular velocity 14*c* of the discs 14*a*, 14*b*. The path velocity 23*c* is dependent on the radius of the disc 14*a*, 14*b* at the respective circumferential point 23, i.e. for a constant angular velocity 14*c*, the path velocity 23*c* increases with an increasing radius of the disc 14*a*, 14*b*. Therefore, by way of this dependency, it can be provided that if the angular velocity 14*c* and/or the shape of the discs 14*a*, 14*b* varies, the path velocity component 19*d* at the first, uppermost circumferential point 19*a* corresponds to the speed 9*c* of the conveyor members 9. It is noted that the term "component" is used in connection with the path velocities of the first, uppermost circumferential point 19*a* of the discs 14*a*, 14*b* for formal reasons, so as to provide a distinction from the path velocity 23*c*, having a horizontal and a vertical component, of an arbitrary circumferential point 23. In the horizontal arrangement shown of the saddle-shaped support 4, and thus of the collation chains, the path velocity component 19*d* in fact corresponds to the total path velocity at the first, uppermost circumferential point 19*a*. For a slightly oblique position of the saddle-shaped support 4, and thus of the collation chains, this would no longer be the case, since in this case there would be a vertical component even at the first, uppermost circumferential point 19*a*. In the present invention, the term "component" therefore always refers to the velocity component of the respective circumferential point extending in the conveying direction 10.

As stated previously, the angular velocity 14*c* of the discs 14*a*, 14*b* can be adjusted via the control system 16. In this way, in accordance with the stated dependencies, the path velocity component 19*d* can be synchronised with the speed 9*c* of the conveyor members 9 indirectly using the control system 16. This may be done in such a way that the control system 16 connected to the actuator 15 initially determines the current angular velocity 14*c* of the discs 14*a*, 14*b*. From this, the path velocity component 19*d* to be expected at the first, uppermost circumferential point 19*a* can be determined. The control system 16 may also be connected to a drive of the conveyor members 9, i.e. of the collation chains, so as to determine the current speed 9*c* of the conveyor members 9, which is required for the synchronisation. The angular velocities 14*c* of the discs 14*a*, 14*b* and/or the speed 9*c* of the conveyor members 9, i.e. of the collation chains, can be determined while the device 1 is in operation. Alternatively, the angular velocity 14*c* and/or the speed 9*c* may also be programmed in. Comparing the path velocity component 19*d* determined in this manner at the first, uppermost circumferential point 19*a* with the speed 9*c* of the conveyor members or of the collation chains demonstrates whether the angular velocity 14*c* of the discs 14*a*, 14*b* has to be changed so as to provide equalisation, as required and within particular tolerances, of the two speeds 9*c* and 19*d*. The equalisation may take place in a manner analogous to that described for orientating the discs 14*a*, 14*b* relative to one another.

FIG. 4 shows the printed product 3 at the moment when it is removed by the gripper member 18. During the transition between the snapshot of FIG. 3 and the snapshot of FIG. 4, the printed product 3 is lifted continuously by the discs 14*a*, 14*b* from the saddle-shaped support 4 and thus from the collation chains. This takes place as a result of the aforementioned increasing radius of the respective uppermost points 19 of the discs 14*a*, 14*b*. In the drawing of FIG. 4, the printed product 3 has been received by the gripper member 18 in the region of the tabs 22, and the fold 2 thereof is already above the highest possible position which can be reached with the device 1, i.e. above a second circumferential point 19*b*, located on the largest radius of the discs 14*a*, 14*b*, from where the printed product 3 can be removed from the delivery region 11 by the gripper member 18. It can thus be provided on the one hand that the printed product 3 has been lifted high enough that no marks are left thereon when it is removed, and on the other hand that the discs 14*a*, 14*b* are not unintentionally pinched.

When the frequency of the printed products 3 arriving in the delivery region 11 varies, the position of the second circumferential point 19*b*, located on the largest radius of the discs 14*a*, 14*b*, can be adapted accordingly based on the angular velocity 14*c* of the discs 14*a*, 14*b*, preferably while the device 1 is in operation. It may be the case that the angular velocity 14*c* when the printed product 3 is lifted by the discs 14*a*, 14*b* has to be low so as to correspond to the speed 9*c* of the conveyor members 9; however, in this case the discs 14*a*, 14*b* would not have time to rotate sufficiently to reach the correct position for receiving the next printed product 3. In this case, the discs 14*a*, 14*b* may be briefly accelerated and braked again cyclically to lift the printed product 3.

The path velocity of the second circumferential point 19*b*, defined by the moment when the printed product 3 is removed, of the discs 14*a*, 14*b* is shown with a path velocity component 19*e*, and is selected in such a way that the size of the path velocity component 19*e* parallel to the conveying direction 10 of the conveyor members 9 substantially corresponds to a velocity component 18*d*, extending in the conveying direction 10 of the conveyor members 9, of the gripper member 18 rotating at an angular velocity. To provide optimally gentle lifting of the printed product 3 from the saddle-shaped support 4 and removal of the printed product 3 from the conveyor member 9, the speed 9*c* of the respective conveyor member 9 and thus the speed of the printed product 3 is adapted to the velocity component 18*d*, extending in the conveying direction 10 at the moment of the lifting, of the gripper member 18, in such a way that the velocity component

18*d* of the gripper member 18 is greater than the speed of the printed product 3. This can be achieved by selecting adapted dimensions of the discs 14*a*, 14*b*. From the moment of the first contact of the printed product 3 at the first circumferential point 19*a*, the printed product 3 is no longer transported by the conveyor members 9, but by the discs 14*a*, 14*b* of the device 1. In this context, the printed product 3 follows a forward movement in the conveying direction 10, and simultaneously, as a result of the increasing radius of the discs 14*a*, 14*b*, a rising movement away from the saddle-shaped support 4. In addition, the printed product 3 undergoes acceleration. A final speed 3*c* of the printed product 3 at the moment of removal by the gripper member 18 is determined by the radius of the discs 14*a*, 14*b* at the second circumferential point 19*b*. To adapt the final speed 3*c* of the printed product 3 to the velocity component 18*d* of the gripper member 18, the increase in radius of the discs 14*a*, 14*b* from the first circumferential point 19*a* to the second circumferential point 19*b* may advantageously be selected in such a way that for a constant angular velocity 14*c* of the discs 14*a*, 14*b*, the radius associated with the second circumferential point 19*b* takes on a value such that the final speed 3*c* of the printed product 3 is substantially equal to the velocity component 18*d* of the gripper member 18.

Instead of a rotating gripper member 18, a plurality of rotating gripper members or even one or more adapted stationary gripper members may be used for removing the printed products 3.

In a preferred embodiment, the discs 14*a*, 14*b* may be braked or halted during the introduction of a printed product 3 to the delivery region 11 of the saddle-shaped support 4, at a moment when they are not impeding the transport of the printed product 3 in the conveying direction 10. The advantage of this option is that instead of being lifted from the saddle-shaped support 4 and introduced to the means 6 for further processing, one or more printed products 3 may initially be guided onwards on the saddle-shaped support 4 in the conveying direction 10, and may be introduced to another application. This may for example be particularly advantageous if individual printed products 3 are to be delivered to quality control as samples. Further, for example, two different batches of printed products 3, which are to be transported to the saddle-shaped support 4 in succession by the conveyor members 9 but require different further processing, can be processed without changing the devices involved, and thus with minimal interruption. One example of this option is a tandem drive, in which two saddle stitchers are arranged in succession. In this case, the printed products travel unimpeded from the saddle-shaped support of the first saddle stitcher to the saddle-shaped support of the second saddle stitcher, where additional printed products are added. Only at the end of the second saddle stitcher are all of the printed products bound together by a stitching machine. By contrast, the printed products of the first saddle stitcher may already be bound in advance in an operation with active delivery, and only subsequently be introduced to the second saddle stitcher.

Although advantageous embodiments of the invention are shown and described, the invention is not limited thereto, but can be configured and used in other ways within the scope of the appended claims.

What is claimed is:

1. A device for delivering a printed product from a saddle-shaped support, the saddle-shaped support including a ridge, a plurality of conveying members and two support parts, and being configured to introduce the printed product, using the conveying members, in a conveying direction to a delivery region of the saddle-shaped support with the printed product straddling the ridge, the two support parts being arranged with mutual spacing so as to form between them a gap extending in the conveying direction at least in the delivery region, at least one gripper member being configured to remove the printed product from the saddle-shaped support in the delivery region, the device comprising:

at least two discs that are configured to pass through the gap, the at least two discs being rotatable about respective fixed rotation axles that are mutually spaced from one another in the conveying direction, each of the discs being configured to project intermittently, during the rotation about the respective fixed rotation axles, above a ridge line of the ridge in the delivery region of the saddle-shaped support so as to continuously lift the printed product from the saddle-shaped support in the delivery region.

2. The device according to claim 1, wherein the at least two discs are substantially equal in size and each of the discs are configured to project, by an uppermost circumferential point, to a substantially same distance above the ridge line.

3. The device according to claim 1, wherein each of the discs are, at least in a circumferential region, substantially spiral-shaped such that a distance between the respective rotation axles and respective uppermost circumferential points is dependent on an angle of the discs.

4. The device according to claim 1, wherein a distance between the respective rotation axles is adjustable.

5. The device according to claim 1, further comprising a control system configured to synchronize a path velocity component in a direction parallel to the conveying direction of a first circumferential point of at least one of the discs with a speed of the conveyor members, the first circumferential point being a point that first contacts the printed product.

6. The device according to claim 1, further comprising a common actuator configured to drive each of the discs at substantially equal angular velocities.

7. The device according to claim 1, further comprising two actuators, each connected to one of the two discs and being configured to drive the discs at substantially equal angular velocities.

8. A method for delivering a printed product from a saddle-shaped support configured to initially introduce the printed product, using conveying members, in a conveying direction to a delivery region of the saddle-shaped support with the printed product straddling the saddle-shaped support, at least one gripper member being configured to remove, after the delivering, the printed product from the saddle-shaped support in the delivery region, the method comprising:

continuously lifting the printed product from the saddle-shaped support in the delivery region towards the at least one gripper member using at least two rotating discs disposed so as to pass through a gap that extends in the conveying direction and that is disposed, at least in the delivery region, between two support parts of the saddle-shaped support, the at least two discs being rotatable about respective fixed rotation axles that are mutually spaced apart from one another in the conveying direction.

9. The method according to claim 8, further comprising determining a path velocity of a first circumferential point of at least one of the discs which first contacts the printed product in the delivery region so that a magnitude of a first path velocity component, parallel to the conveying direction of the conveyor members, is substantially equal to a speed of the conveyor member.

10. The method according to claim 8, further comprising determining a path velocity of a second circumferential point of at least one of the discs which contacts the printed product in the delivery region at a moment when the printed product is removed by the at least one gripper member so that a magnitude of a second path velocity component, parallel to the conveying direction of the conveyor members, substantially corresponds to a velocity component of the at least one gripper member extending in the conveying direction.

11. The method according to claim 8, wherein the at least two discs have high angular velocities that are substantially equal to each other.

12. The method according to claim 11, wherein each of the discs has a constant angular velocity.

13. The method according to claim 11, further comprising adjusting the angular velocity of each of the discs based on a frequency of successive ones of the printed products being introduced in the delivery region.

14. The method according to claim 12, wherein the adjusting is performed while the conveying members are in operation.

15. The method according to claim 8, wherein the printed product is disposed on the at least two discs at a moment that the at least one gripper member removes the printed product.

16. The method according to claim 8, further comprising orienting the at least two discs in an initial position such that respective uppermost circumferential points of the discs project, at least intermittently, by a substantially equal distance past a ridge line of the saddle-shaped support at a moment after the printed product is introduced into the delivery region.

17. The method according to claim 8, further comprising at least one of braking and halting the at least two discs after the printed product has been introduced into the delivery region at a moment when respective uppermost circumferential points of the discs do not project past a ridge line of the saddle-shaped support.

* * * * *